US011780043B2

(12) United States Patent
Maxwell

(10) Patent No.: US 11,780,043 B2
(45) Date of Patent: Oct. 10, 2023

(54) MANUAL BLADE SHARPENING TOOL

(71) Applicant: Timothy Maxwell, Ontario (CA)

(72) Inventor: Timothy Maxwell, Ontario (CA)

(73) Assignee: Timothy Maxwell, Ontario (CA)

( * ) Notice: Subject to any disclaimer, the term of this patent is extended or adjusted under 35 U.S.C. 154(b) by 392 days.

(21) Appl. No.: 16/768,145

(22) PCT Filed: Nov. 14, 2018

(86) PCT No.: PCT/CA2018/051439
§ 371 (c)(1),
(2) Date: May 29, 2020

(87) PCT Pub. No.: WO2019/104419
PCT Pub. Date: Jun. 6, 2019

(65) Prior Publication Data

US 2020/0316745 A1 Oct. 8, 2020

(30) Foreign Application Priority Data

Dec. 1, 2017 (CA) ..... CA 2987362

(51) Int. Cl.
*B24B 3/00* (2006.01)
*B24D 15/06* (2006.01)

(52) U.S. Cl.
CPC ..... *B24B 3/003* (2013.01); *B24D 15/066* (2013.01)

(58) Field of Classification Search
CPC ..... B24B 3/003; B24D 15/066; B24D 15/06; A63C 3/10
See application file for complete search history.

(56) References Cited

U.S. PATENT DOCUMENTS

| | | | | |
|---|---|---|---|---|
| 300,656 A | | 6/1884 | Pierre | |
| 2,053,359 A | | 9/1936 | Wright | |
| 2,054,495 A | * | 9/1936 | Leo | B24D 15/066 451/558 |
| 2,327,717 A | | 8/1943 | Johnson | |
| 2,398,566 A | * | 4/1946 | Talbert | B24D 15/066 76/83 |

(Continued)

FOREIGN PATENT DOCUMENTS

| | | |
|---|---|---|
| WO | 9705988 A1 | 2/1997 |
| WO | 2010069082 A1 | 6/2010 |

OTHER PUBLICATIONS

International Search Report dated Feb. 18, 2019 from corresponding PCT Patent Application PCT/CA2018/051439.

*Primary Examiner* — Joel D Crandall
*Assistant Examiner* — Makena S Markman
(74) *Attorney, Agent, or Firm* — Grogan, Tuccillo & Vanderleeden, LLP

(57) ABSTRACT

In at least one embodiment, the present invention discloses a manual blade sharpening tool having a longitudinally extending at least partial channel defined by a longitudinally extending first channel wall, a cutter pocket and a distal planar guide surface located in the longitudinally extending first channel wall, and a longitudinally extending cutter having a longitudinally extending first cutter wall, a longitudinally extending second cutter wall and a transverse cutter surface, the transverse cutter received in the cutter pocket such that one of the longitudinally extending first cutter wall and the longitudinally extending second cutter wall abuts the cutter pocket.

12 Claims, 10 Drawing Sheets

(56) References Cited

U.S. PATENT DOCUMENTS

| | | | | | |
|---|---|---|---|---|---|
| 2,542,281 | A | | 2/1951 | Lefteruk | |
| 3,585,880 | A | * | 6/1971 | Kabriel | B24D 15/066 76/83 |
| 4,078,337 | A | * | 3/1978 | Chiasson | B24B 3/003 451/303 |
| 4,815,240 | A | | 3/1989 | Larson | |
| 5,189,845 | A | * | 3/1993 | Courchesne | A63C 3/10 76/83 |
| 5,197,232 | A | | 3/1993 | Ellestad | |
| 5,445,050 | A | * | 8/1995 | Owens | B24D 15/066 76/83 |
| 5,564,973 | A | | 10/1996 | Salvail | |
| 5,916,018 | A | | 6/1999 | Watt | |
| 6,030,283 | A | * | 2/2000 | Anderson | B24D 15/066 451/558 |
| 8,944,889 | B2 | * | 2/2015 | Frommer | B24B 3/003 451/45 |
| 2006/0065076 | A1 | * | 3/2006 | Friol | A63C 3/10 76/83 |
| 2008/0062052 | A1 | | 3/2008 | Suzuki et al. | |

* cited by examiner

PRIOR ART

PRIOR ART

PRIOR ART

MANUAL BLADE SHARPENING TOOL

CROSS REFERENCE TO RELATED APPLICATION

This application is a national stage application of International Application No. PCT/CA2018/051439 filed on Nov. 14, 2018, which claims priority to Canadian Patent Application No. 2987362 filed on Dec. 1, 2017, both of which are hereby incorporated by reference in their entireties.

FIELD

The present invention relates to hand tools. More specifically, the present invention relates to a hand tool for sharpening and maintaining the cutting edge of a blade, such as but not limited to a skate blade.

BACKGROUND

Bladed tools have been known since antiquity and exist in a variety of forms for a nearly limitless number of practical applications. Historically, blade materials have progressed from hard but fragile flaked stone to modern steel alloys which are extremely tough but not necessarily particularly hard. As such, modern steel blades generally require regular sharpening and maintenance to maintain a sharp working edge.

To this point, typical blade geometry involves a first surface that intersects with a second surface at a working edge. Ideally, this edge is maintained to minimize roundness as much as possible so that the blade can penetrate or slice through the material being cut with minimal friction.

However, as a blade is used the working edge can blunt (or develop roundness) thereby affecting the blades ability to cut or slice efficiently. Moreover, generally speaking when a blade is made of a softer material (such as steel) the blade can absorb impact and can generally resist catastrophic fractures but softer materials also tend to deform under pressure and as such the working edge is more likely to develop roundness over time.

As such, it is generally required to regularly remove or reform the material that constitutes the blade's working edge from time to time in order to restore the blade's performance. This process can require specialized tools that can maintain the original blade geometry in as precise a manner as possible. Given the many types of blades that exist, a significant amount of sharpening equipment may be required to maintain a number of blades, specifically when the blade has unique geometries that must be maintained.

As will be discussed in further detail herein, one example of a common blade that has unique geometry is a skate blade, which is mounted in a downwardly projecting manner from the underside of a skate boot in order to permit a wearer to "cut into" (or, frictionally engage with) an ice surface, thereby allowing the user to skate across an otherwise frictionless surface.

As will be appreciated by the skilled person, ice is a very hard surface and moreover skates are subject to a number of physical shocks. As such, skate blades are generally manufactured out of durable but relatively soft steel. Accordingly, skaters must regularly sharpen their skates in order to reshape and restore the working edge of the skate blades in order to maintain performance.

However, given the unique blade geometry of a skate blade this sharpening process generally involves powered sharpening tools (such as an adjustable grinding wheel) that requires a highly skilled operator.

Moreover, known hand sharpening tools have been developed that involve the removal of skate blade material through abrasion but these solutions do not provide a sufficiently precise and efficient way to reshape and restore the working edge of skate blades in a manual manner.

Furthermore, known manual skate blade sharpeners generally sharpen the entire blade surface (including both blade edges) at the same time which can lead to reduced overall precision and accuracy. Moreover, if the entire blade surface is sharpened simultaneously, this reduces the flexibility the user has in choosing the preferred skate blade hollow profile and bite angle as will be discussed in further detail below.

Accordingly, there is need for a hand sharpening tool that provides a sufficiently precise and accurate way to reshape and restore the unique geometry of the working edge of a skate blade in a manual manner.

BRIEF DESCRIPTION

It is contemplated that the present invention discloses a hand sharpening tool that provides a sufficiently precise and efficient way to reshape and restore the unique geometry of the working edge of a skate blade in a manual manner.

In at least one embodiment, the present invention discloses a manual blade sharpening tool having a longitudinally extending at least partial channel defined by a longitudinally extending first channel wall, a cutter pocket and a distal planar guide surface located in the longitudinally extending first channel wall, and a longitudinally extending cutter having a longitudinally extending first cutter wall, a longitudinally extending second cutter wall and a transverse cutter surface, the transverse cutter received in the cutter pocket such that one of the longitudinally extending first cutter wall and the longitudinally extending second cutter wall abuts the cutter pocket.

BRIEF DESCRIPTION OF THE DRAWINGS

The present invention will be better understood in connection with the following Figures, in which.

DETAILED DESCRIPTION OF THE EMBODIMENTS

Figure 1:
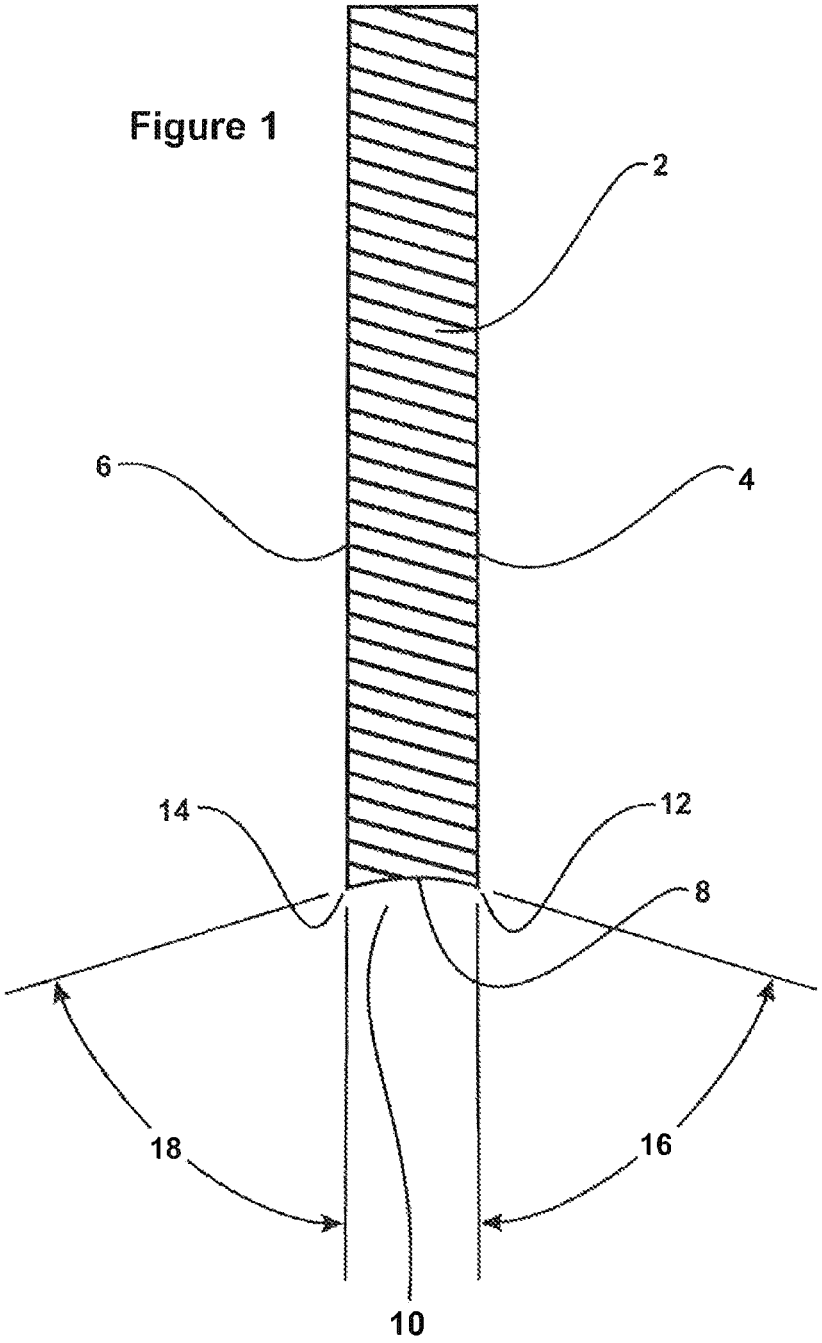
FIG. 1 is a close up, cross-sectional view of a prior-art skate blade for use in connection with the present invention.

It is contemplated that the present invention discloses a hand sharpening tool that provides a sufficiently precise and efficient way to reshape and restore the unique geometry of the working edge(s) of a skate blade in a manual manner.

As will be readily appreciated by the skilled person, the present invention can be manufactured out of any suitable material and of any suitable dimensions as will be readily appreciated by the skilled person. Moreover, it will be readily apparent that the present invention can be manufactured by way of any suitable technique, and can be comprised of a single unitary component or multiple components suitably joined together as required by the specific end user application of the present invention.

As will be appreciated by the skilled person, the present invention relates to a manual blade sharpening tool that, in at least one embodiment, is specifically contemplated to be used to sharpen and maintain skate blades.

Many skate blades do not have a simple orthogonal arrangement but rather consist of a first vertical blade wall that is parallely spaced apart from a second vertical blade wall. A generally concave blade surface joins a distal end of the first blade wall at a first blade edge with a distal end of the second blade wall at a second blade edge. In many instances, the generally concave blade surface has an arcuate cross section wherein the defined arc is aligned with a circle of a given radius R. In other embodiments the generally concave blade surface may be semi-arcuate or comprised of a number of adjoining straight or curved surfaces, depending on the particular needs of a particular end user application.

The concave space defined between the first blade edge, the second blade edge and the generally concave blade surface is known as the blade "hollow". Moreover, R is often termed the "radius of hollow" or the "groove radius".

Historically, skate blades were sharpened using a grinding wheel wherein the rotating abrasive wheel has a cross sectional profile that can be defined by an arc having the same radius R as that of the arc defined by the concave blade surface. For example, R=0.63 to 5.08 cm is quite common for many figure, hockey and recreational skates.

In some applications, skate blades may be sharpened with a "dual hollow" skate blade profile—that is, the profile of the skate blade is not truly comprised of an arc from a single circle having a radius R but in fact two arcs having identical radiuses R are superimposed on one another to create one, smooth semiarcuate profile. In other words, the first skate blade edge is sharpened with a tool having a grinding profile (such as, but not limited to a grinding wheel) having a radius R and a first centre, and the second skate blade edge is sharpened with a tool having a grinding profile having a radius R and a second centre, where the second centre is laterally displaced from the first centre by some small distance. This can result in a "dual hollow" skate blade profile that is preferred in some applications. However, this "dual hollow profile" is extremely difficult to achieve with known manual tools.

As will be readily understood by the skilled person, the wall of the skate blade and the blade surface creates a blade edge having an angle that can be measured. This angle is commonly known as the "bite angle" and can range from 90° in speed skating applications to as low as 80° in figure skating and hockey applications.

Moreover, skate blades are often "rockered" in the longitudinal direction. This means that, when viewed from the side, at least a portion of many skate blades are also arcuately shaped or curved wherein the rocker radius or shape can vary greatly depending on the user's needs, skill levels and the activity which the skate will be used for.

Accordingly, it will be readily appreciated that a suitable manual blade sharpening tool will be required to maintain the geometries of the blade in a sufficiently precise way so that the skate blade performance is not compromised and the user realizes the benefits of the manual tool without suffering the potentially severe drawbacks (including limited hollow profiles and bite angles of reduced accuracy) from not using professional skate sharpening equipment.

In at least one embodiment, the present manual blade sharpening tool can include a longitudinally extending at least partial channel that can be at least partially housed within a body. In some embodiments, the body is contemplated to function as an external handle that the user can grip when using the present tool.

The longitudinally extending at least partial channel is comprised of a first channel wall and in some embodiments can further include an opposing second channel wall that is spaced apart from the first channel wall. In some embodiments, it is contemplated that the longitudinally extending at least partial channel is further comprised of a bottom channel wall that adjoins a bottom edge of the first channel wall to a bottom edge of the second channel wall.

In some embodiments it is contemplated that the first channel wall is parallel to the optional second channel wall while in other embodiments it is contemplated that the first channel wall is not parallel to the optional second channel wall. As discussed herein, in some embodiments the opposing second channel wall is present however it is also contemplated that this feature is not present in some embodiments. Generally speaking, it is contemplated that the longitudinally extending at least partial channel is sized such that it is wide enough to receive a skate blade and deep enough to at least partially receive a skate blade.

It is contemplated that one of the first channel wall and the second channel wall includes a distal planar guide surface and a cutter pocket. In some embodiments it is contemplated that both the first channel wall and the second channel wall include a distal planar guide surface and a cutter pocket.

It is further contemplated that in some embodiments a guide plate is present having a first surface and an opposing second surface which includes the distal planar guide surface and the cutter pocket. In some embodiments, the first surface abuts one of the first channel wall and the second channel wall. In some embodiments, it is contemplated that the second surface includes the cutter pocket. Moreover, in some embodiments, it is contemplated that the second surface includes and partially defines the cutter pocket as will be discussed in further detail below.

It is contemplated that the present manual blade sharpening tool further includes a longitudinally extending cutter that has a first cutter wall, a second cutter wall and a transverse cutter surface. It is contemplated that the longitudinally extending cutter is received within and abuts the cutter pocket. In some embodiments, it is contemplated that at least one of the first cutter wall and the second cutter wall are generally planar surfaces and generally parallel to the distal planar guide surface.

In some embodiments it is contemplated that the longitudinally extending cutter is integrally formed with the cutter pocket (and, optionally, with the guide plate or the channel wall depending on the embodiments) and in other arrangements it is contemplated that these components are separate components suitably joined together.

It is further contemplated that the longitudinally extending cutter can be laterally positionable within the cutter pocket to allow the user to adjust the operation of the present manual blade sharpening tool as necessary. For example, it is contemplated that a threaded set screw can be utilized to adjust the lateral position of the longitudinally extending cutter within the pocket.

Alternatively, it is contemplated that the longitudinally extending cutter and the cutter pocket may each have angled abutting surfaces that can be translated longitudinally relative to one another, thereby providing a manner in which the lateral position of the longitudinally extending cutter within the pocket can be adjusted.

As such, it will be readily understood by the skilled person that the cutter pocket lateral depth can be variable to achieve different sharpening geometry or different dual hollow skate blade profiles.

Moreover and as discussed herein, it is contemplated that in some embodiments the longitudinally extending cutter has a transverse cutter surface having a transverse cutter profile that is arcuate and defined by an arc having a radius R.

In other embodiments, it is contemplated that the transverse cutter profile is straight, beveled or curved in a non-arcuate manner. In some embodiments it is contemplated that the transverse cutter profile is symmetrical about a central longitudinal axis of the longitudinally extending cutter while in other embodiments it is contemplated that the transverse cutter profile is asymmetrical about a central longitudinal axis of the longitudinally extending cutter.

In some embodiments, it is contemplated that the longitudinally extending cutter is removeable so that a number of longitudinally extending cutters (with differing values of R or transverse cutter profiles) can be replaced in the present manual blade sharpening tool as needed by a user.

In some embodiments the cutter pocket lateral depth can be altered to allow for different values of R or transverse cutter profiles depending on the needs of the particular end-user application.

As discussed herein, in some embodiments it is contemplated that the transverse cutter profile is asymmetrically oriented such that it can only engage a single blade edge of a skate blade at a time, as will be discussed in further detail herein. In some embodiments, it is contemplated that the transverse cutter profile is asymmetrical and effectively forms an angle between 80° and 90° from vertical at the proximal point where the cutter engages the edge of the skate blade in order to maintain the "bite angle" of choice. In some embodiments, it is contemplated that the transverse cutter profile is asymmetrical and is effectively perpendicular from vertical at the distal point where the cutter engages the "hollow" portion of the lower blade surface.

In other embodiments it is contemplated that the transverse cutter profile is symmetrically oriented such that it can engage both blade edges of a skate blade at a time.

As discussed herein, it is contemplated that the cutter and the guide plate can be a single unitary component or alternatively can be separate components that are suitably joined together.

In some embodiments, it is contemplated that the cutter can have a number of longitudinally spaced apart teeth, wherein each tooth has the same transverse cutter profile. In some embodiments, it is contemplated that the teeth are semi-helical, straight or angled, among any other suitable shapes that will be readily understood by the skilled person.

As will be appreciated by the skilled person, the cutter can be manufactured out of any sufficiently hard material that permits sharpening (removal of skate blade material through "shaving") of the skate blade. Generally speaking, it is contemplated that the cutter shall be manufactured of a material that is harder than a skate blade. Suitable cutter materials include, but are not limited to, tungsten carbide, tool steels and ceramics, among other suitable materials that will be readily appreciated by the skilled person.

Turning to FIG. 1, a cross-sectional view of a prior art skate blade is illustrated. In this particular instance, skate blade 2 has a first blade wall 4, a second blade wall 6, and a lower blade surface 8.

As will be readily understood by the skilled person, first blade wall 4 is parallel to second blade wall 6 and lower blade surface 8 is concave, thereby creating a blade hollow 10. Moreover, the first blade wall 4 adjoins the lower blade surface 8 at a first blade edge 12 and the second blade wall 6 adjoins the lower blade surface 8 at a second blade edge 14.

The angles 16,18 formed by the first blade edge 12 and the second blade edge 14 is known as the bite angle, as will be readily understood by the skilled person.

Figure 2:
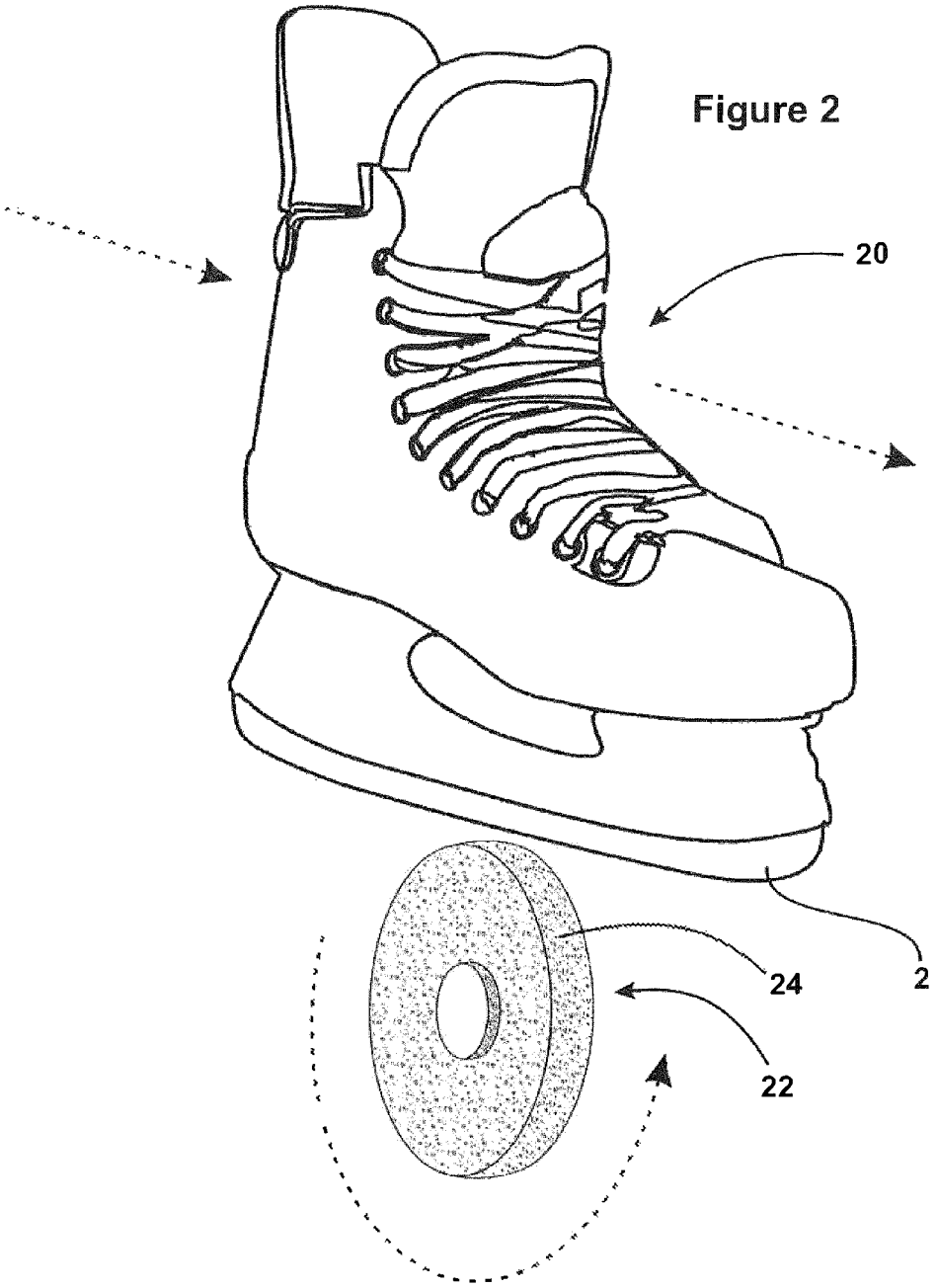
FIG. 2 is a perspective view of a prior art skate and a grinding wheel for sharpening the skate blade of FIG. 1.
Figure 3:
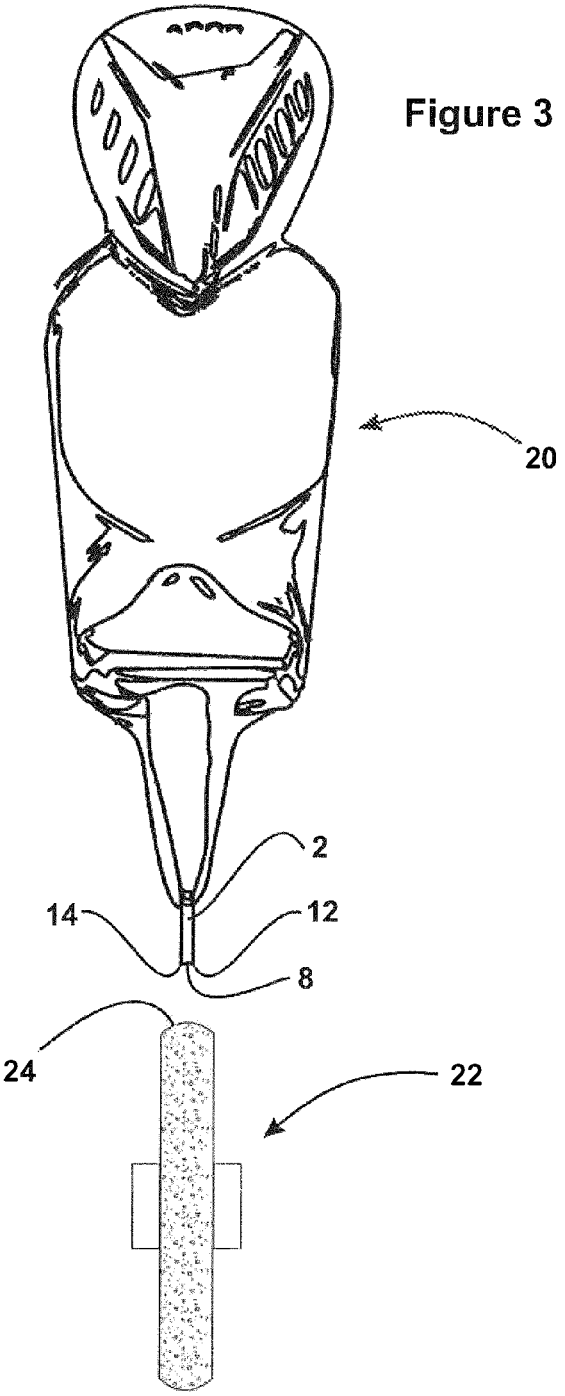
FIG. 3 is an end view of a prior art skate and a grinding wheel for sharpening the skate blade of FIG. 1.

Turning to FIGS. 2 and 3, two views of how a skate is traditionally sharpened are illustrated. With reference to FIG. 2, a perspective view of a prior art skate and grinding wheel are illustrated. Moreover and with reference to FIG. 3, an end view of a prior art skate and grinding wheel are illustrated.

In these embodiments, a skate 20 having a skate blade 2 is sharpened with a grinding wheel 22 that has a transverse grinding profile 24. In this embodiment, the transverse grinding profile 24 is arcuate, however as will be appreciated by the skilled person any suitable transverse grinding profile can be utilized depending on the needs of the particular end user application.

In this way, grinding wheel 22 can be used to maintain the geometry of skate blade 2 and specifically, lower blade surface 8, first blade edge 12 and second blade edge 14. However and as will be readily appreciated by the skilled person, operating a grinding wheel requires significant experience, space and the proper equipment to hold the grinding wheel and the skate in a secure and highly precise manner.

Figure 4:
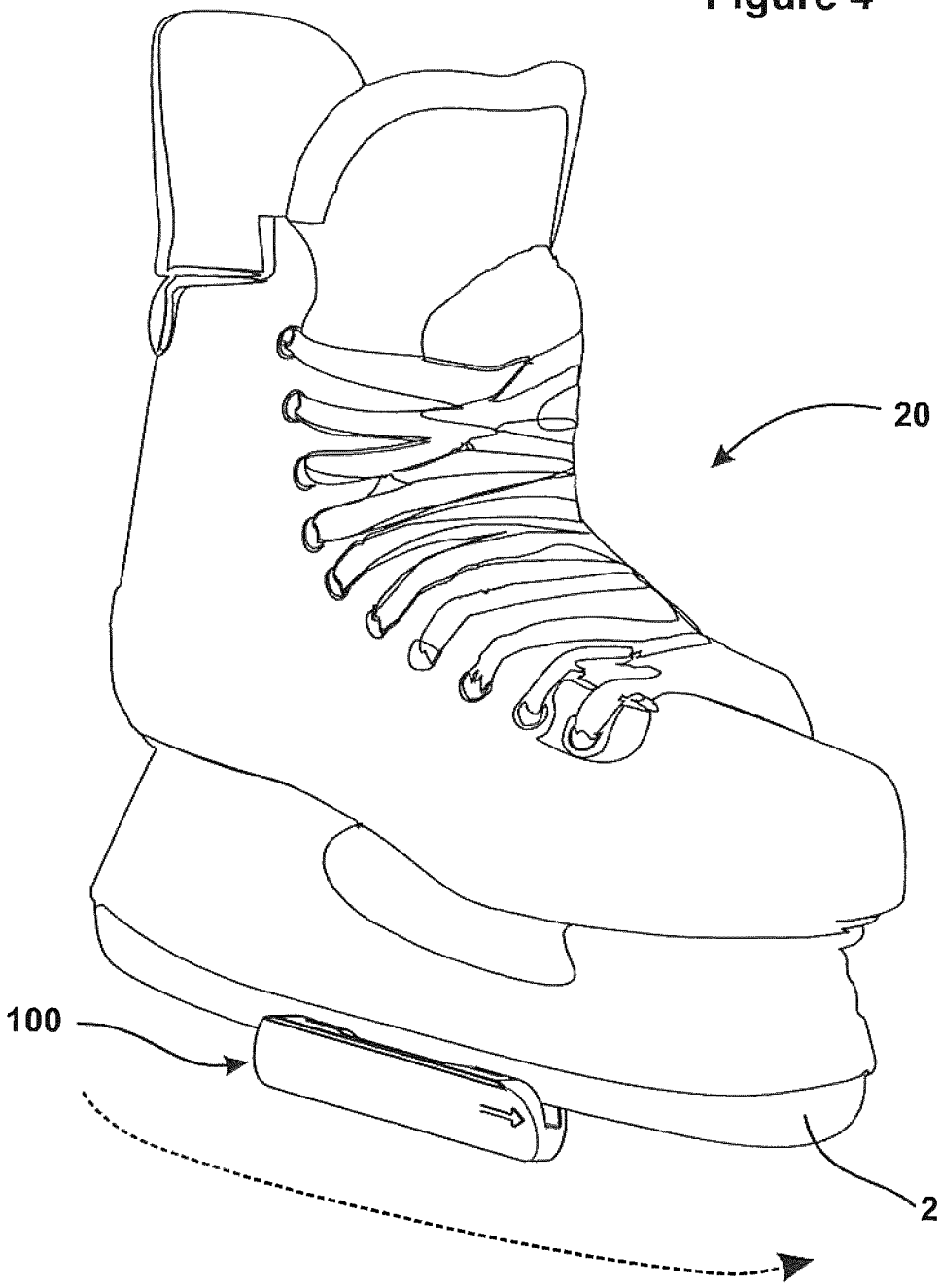
FIG. 4 is a perspective view of a manual blade sharpening tool for sharpening the skate blade of FIG. 1 in accordance with one embodiment of the present invention.
Figure 5:
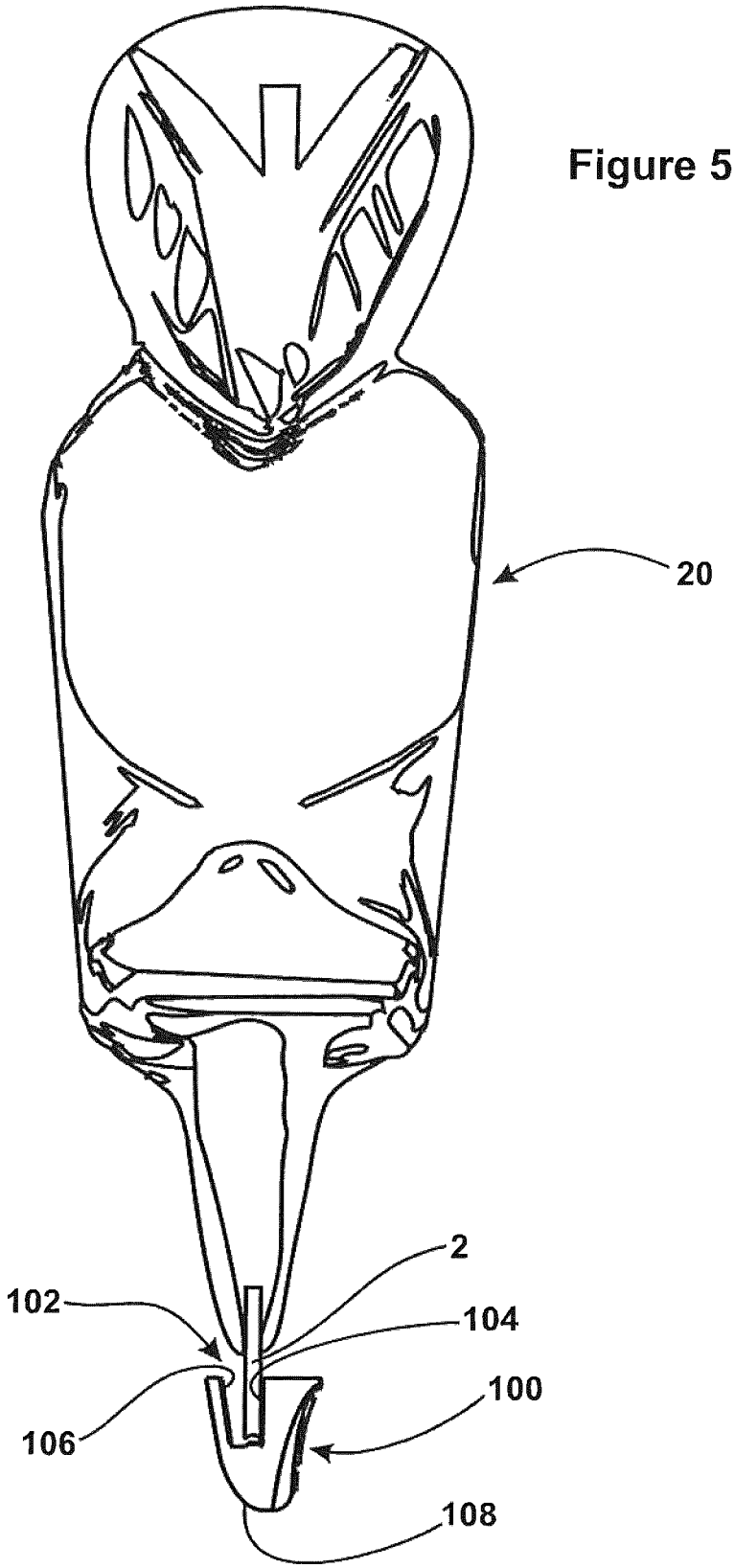
FIG. 5 is an end view of a manual blade sharpening tool for sharpening the skate blade of FIG. 1 in accordance with one embodiment of the present invention.

Turning to FIGS. 4 and 5, a perspective view of a prior art skate and one embodiment of a manual blade sharpening tool in accordance with the present invention is illustrated at FIG. 4 and an end view of a prior art skate and one embodiment of a manual blade sharpening tool in accordance with the present invention is illustrated at FIG. 5. In this embodiment, a skate 20 having a skate blade 2 is sharpened with manual blade sharpening tool 100.

With reference to FIG. 5, in this embodiment manual blade sharpening tool 100 has a longitudinally extending at least partial channel 102 having a first longitudinally extending channel wall 104 and a second longitudinally extending channel wall 106. The longitudinally extending at least partial channel 102 is received in a body 108, which can also function as a handle in use.

In this embodiment, first longitudinally extending channel wall 104 is not perpendicular to second longitudinally extending channel wall 106 however arrangements where the channel walls are parallel to one another are also contemplated. In this way, it is contemplated that the longitudinally extending at least partial channel 102 is sized such that it is wide enough to receive skate blade 2 and deep enough to at least partially receive skate blade 2 however other arrangements are also contemplated.

Figure 6:
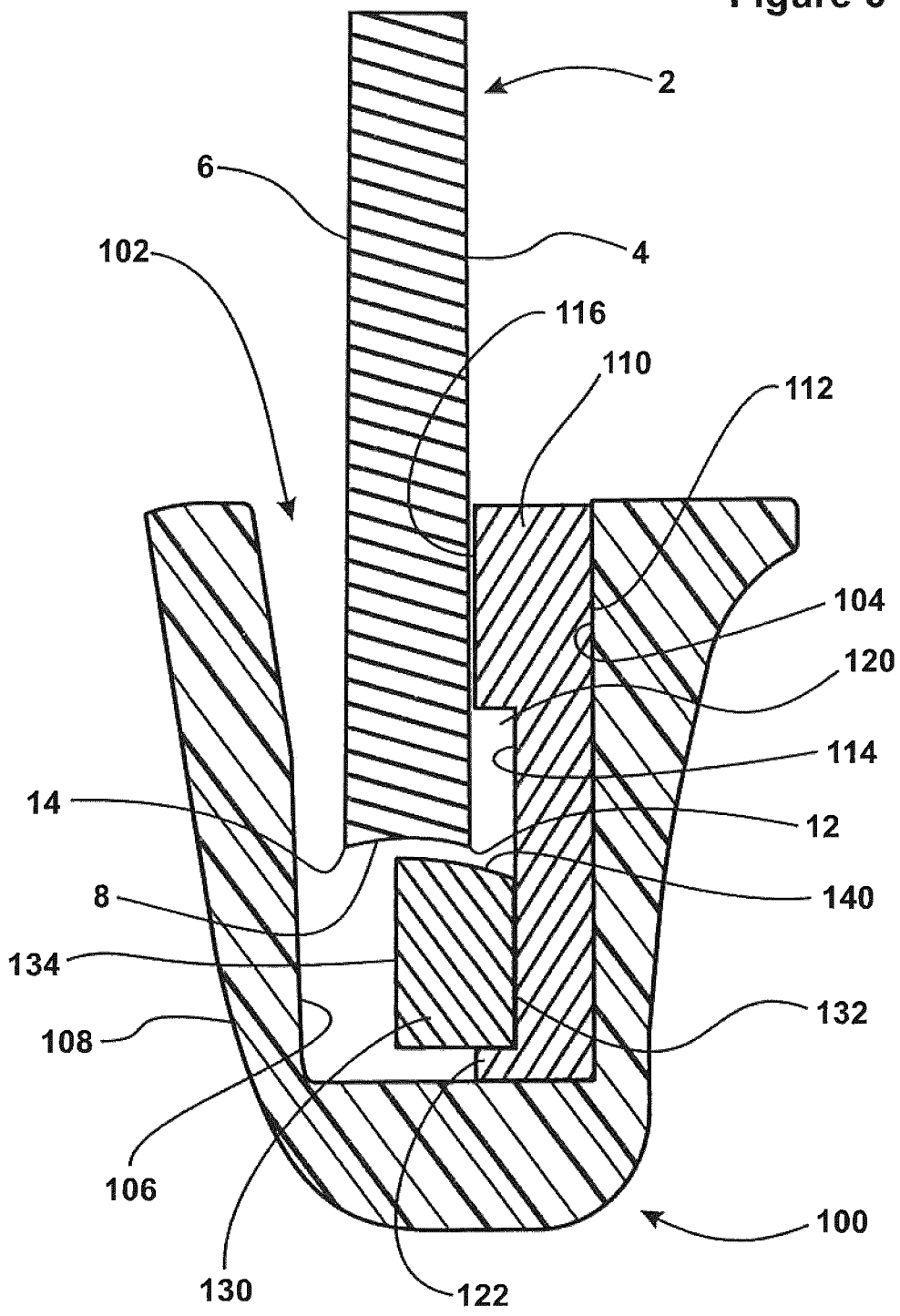
FIG. 6 is a cross-sectional view of the manual blade sharpening tool of FIGS. 4 and 5 for sharpening the skate blade of FIG. 1 in accordance with one embodiment of the present invention.

Turning to FIG. 6, a cross-sectional view of a prior art skate blade and one embodiment of a manual blade sharpening tool in accordance with the present invention is illustrated. In this embodiment, manual blade sharpening tool 100 includes a longitudinally extending at least partial channel 102 having a first longitudinally extending channel wall 104 that is not perpendicular to a second longitudinally extending channel wall 106. In this embodiment, second longitudinally extending channel wall 106 is comprised of two mating surfaces, however other arrangements are also contemplated. In this embodiment, the longitudinally extending at least partial channel 102 is at least partially housed within a body 108.

In this embodiment, a guide plate 110 is included having a first surface 112 that abuts the first longitudinally extending channel wall 104, an opposing second surface 114 and a distal planar guide surface 116. In this embodiment, first surface 112, second surface 114 and distal planar guide surface 116 are all parallel surfaces, however other arrangements where these surfaces are not parallel are also contemplated.

In this embodiment, a cutter pocket 120 is provided that incorporates second surface 114. Moreover, a shoulder 122 is provided that can, in some embodiments, abut a longitudinally extending cutter 130. It is contemplated that cutter 130 includes a first cutter wall 132 and a second cutter wall 134. In this embodiment it is contemplated that first cutter wall 132 abuts and is secured to second surface 114 of the cutter pocket 120 of the guide plate 110. As discussed herein, it is contemplated that this guide plate 110 and cutter 130 can be integral parts of manual blade sharpening tool 100 or alternatively can be separate components suitably joined together.

Figure 9:
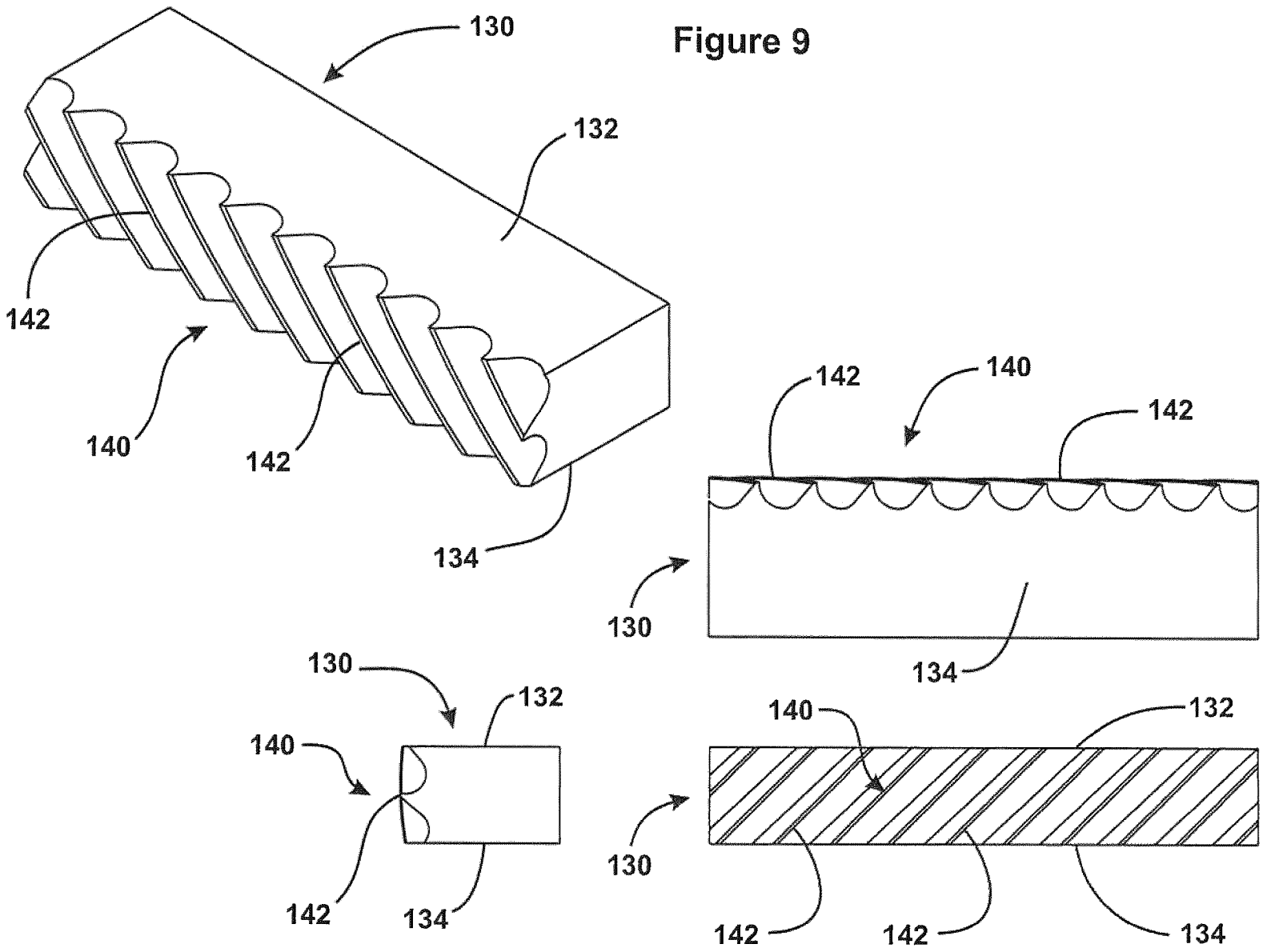
FIG. 9 is a perspective view of a longitudinally extending cutter for sharpening the skate blade of FIG. 1 in accordance with one embodiment of the present invention.

As discussed herein and as can be seen in FIG. 9, longitudinally extending cutter 130 has a transverse cutter surface 140 that has a particular transverse cutter profile. In this embodiment, the transverse cutter profile is assymetrical and arcuate wherein the corresponding arc has a radius R, however other arrangements are also contemplated.

In this way, a skate blade 2 having a first blade wall 4, a second blade wall 6, and a lower blade surface 8 can be at least partially received in a longitudinally extending at least partial channel 102 of manual blade sharpening tool 100. In this embodiment, first blade wall 4 adjoins the lower blade surface 8 at a first blade edge 12 and the second blade wall 6 adjoins the lower blade surface 8 at a second blade edge 14, as discussed in relation to FIG. 1.

As such, transverse cutter surface 140 engages lower blade surface 8 at first blade edge 12 in order to sharpen and maintain the geometry (including the bite angle and radius of hollow) of blade 2 at first blade edge 12. Moreover and as will be understood by the skilled person, the entire apparatus is reversible such that transverse cutter surface 140 engages lower blade surface 8 at second blade edge 14 in order to sharpen and maintain the geometry (including the bite angle and radius of hollow) of blade 2 at second blade edge 14. In this embodiment it is contemplated that only one edge 12, 14 of skate blade 2 is engaged and sharpened at a time, however other arrangements are also contemplated as will be discussed herein.

As will be also understood by the skilled person, depending on the value of R, the shape of the transverse cutter profile, the width of blade 2 and the location of cutter 130 within the cutter pocket 120 a variety of arrangements are contemplated that can result in a limitless number of possible geometries (including the shape of the lower blade surface 8, the bite angle and radius of hollow) of blade 2.

Figure 7:
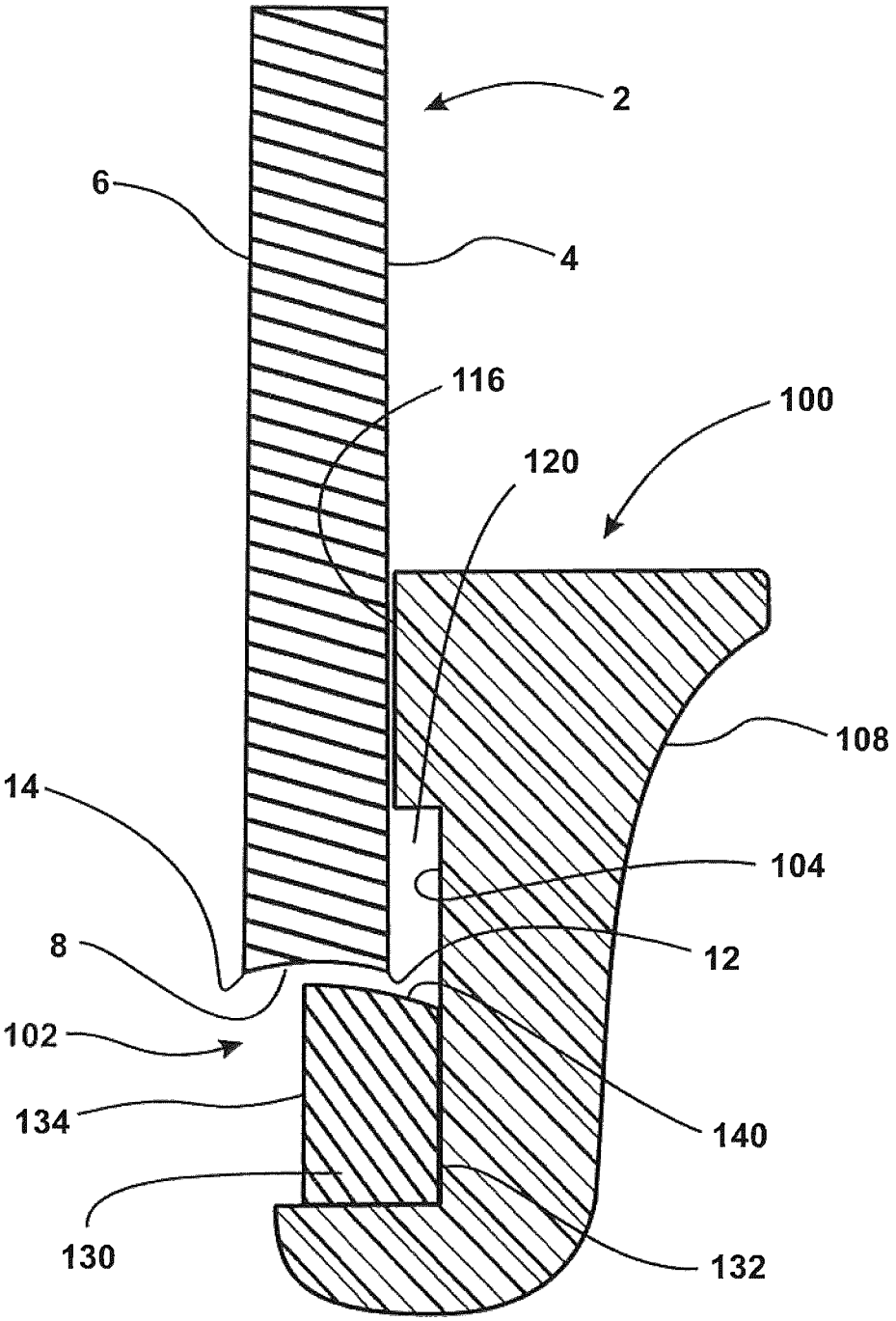
FIG. 7 is a cross-sectional view of another embodiment of a manual blade sharpening tool for sharpening the skate blade of FIG. 1 in accordance with the present invention.

Turning to FIG. 7, a cross-sectional view of a prior art skate blade and another embodiment of a manual blade sharpening tool in accordance with the present invention is illustrated. In this embodiment, manual blade sharpening tool 100 includes a longitudinally extending at least partial channel 102 having a longitudinally extending first channel wall 104. In this embodiment, the longitudinally extending at least partial channel 102 is at least partially housed within a body 108.

In this embodiment, a longitudinally extending first channel wall 104 has a distal planar guide surface 116. In this embodiment, longitudinally extending first channel wall 104 and distal planar guide surface 116 are parallel surfaces, however other arrangements where these surfaces are not parallel are also contemplated.

In this embodiment, a cutter pocket 120 is provided in first longitudinally extending channel wall 104. It is contemplated that a longitudinally extending cutter 130 includes a first cutter wall 132 and a second cutter wall 134. In this embodiment it is contemplated that first cutter wall 132 abuts and is secured to cutter pocket 120 of first longitudinally extending channel wall 104.

As discussed herein and as can be seen in FIG. 9, longitudinally extending cutter 130 has a transverse cutter surface 140 that has a particular transverse cutter profile. In this embodiment, the transverse cutter profile is assymetrical and arcuate wherein the corresponding arc has a radius R, however other arrangements are also contemplated. In this embodiment it is contemplated that only one edge 12, 14 of skate blade 2 is engaged and sharpened at a time however other arrangements are also contemplated as discussed herein.

Figure 8:
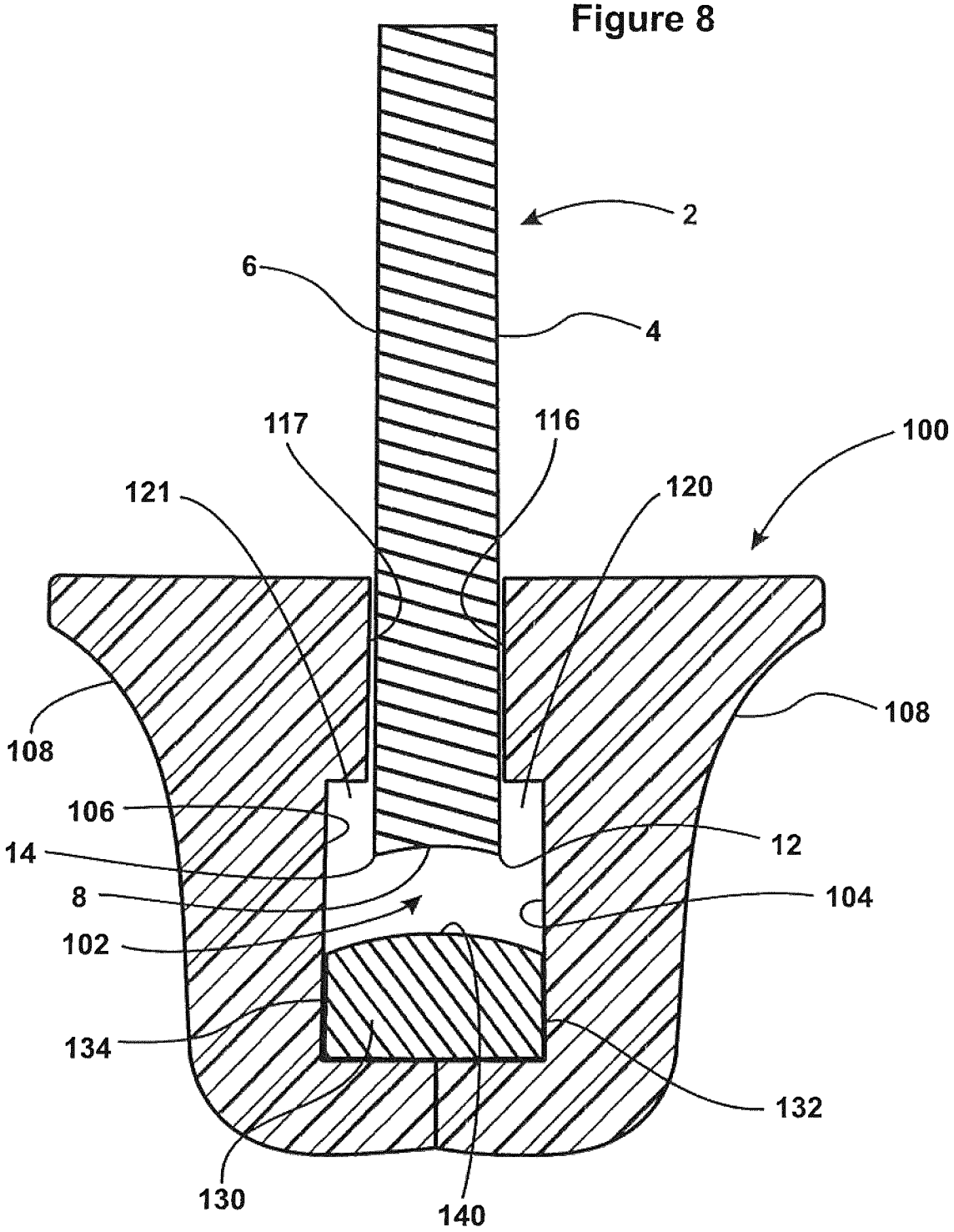
FIG. 8 a cross-sectional view of yet another embodiment of a manual blade sharpening tool for sharpening the skate blade of FIG. 1 in accordance with the present invention.

Turning to FIG. 8, a cross-sectional view of a prior art skate blade and another embodiment of a manual blade sharpening tool in accordance with the present invention is illustrated. In this embodiment, manual blade sharpening tool 100 includes a longitudinally extending at least partial channel 102 having a longitudinally extending first channel wall 104 and a longitudinally extending second channel wall 106. In this embodiment, the longitudinally extending at least partial channel 102 is at least partially housed within a body 108.

In this embodiment longitudinally extending first channel wall 104 has a distal planar guide surface 116 and longitudinally extending second channel wall 106 has a second distal planar guide surface 117. In this embodiment, distal planar guide surface 116 and second distal planar guide surface 117 are all parallel surfaces, however other arrangements where these surfaces are not parallel are also contemplated.

In this embodiment, a cutter pocket 120 is provided in longitudinally extending first channel wall 104 and a second cutter pocket 121 is provided in longitudinally extending second channel wall 106. In this embodiment, it is contemplated that cutter 130 includes a first cutter wall 132 that abuts cutter pocket 120 and a second cutter wall 134 that abuts second cutter pocket 121.

As discussed herein, longitudinally extending cutter 130 has a transverse cutter surface 140 that has a particular transverse cutter profile. In this embodiment, the transverse cutter profile is symmetrical and arcuate wherein the corresponding arc has a radius R, however other arrangements are also contemplated. In this embodiment it is contemplated that only two edges 12, 14 of skate blade 2 are engaged and sharpened at a time however other arrangements are also contemplated as discussed herein.

With reference to FIG. 9, one embodiment of a longitudinally extending cutter 130 is illustrated which includes a first cutter wall 132 and a second cutter wall 134. In this embodiment, longitudinally extending cutter 130 has a transverse cutter surface 140 that is a surface section from a helical blade and as such includes a number of spaced apart semi-helical teeth 142. In this embodiment, the transverse cutter profile is assymetrical and arcuate wherein the corresponding arc has a radius R.

Figure 10:
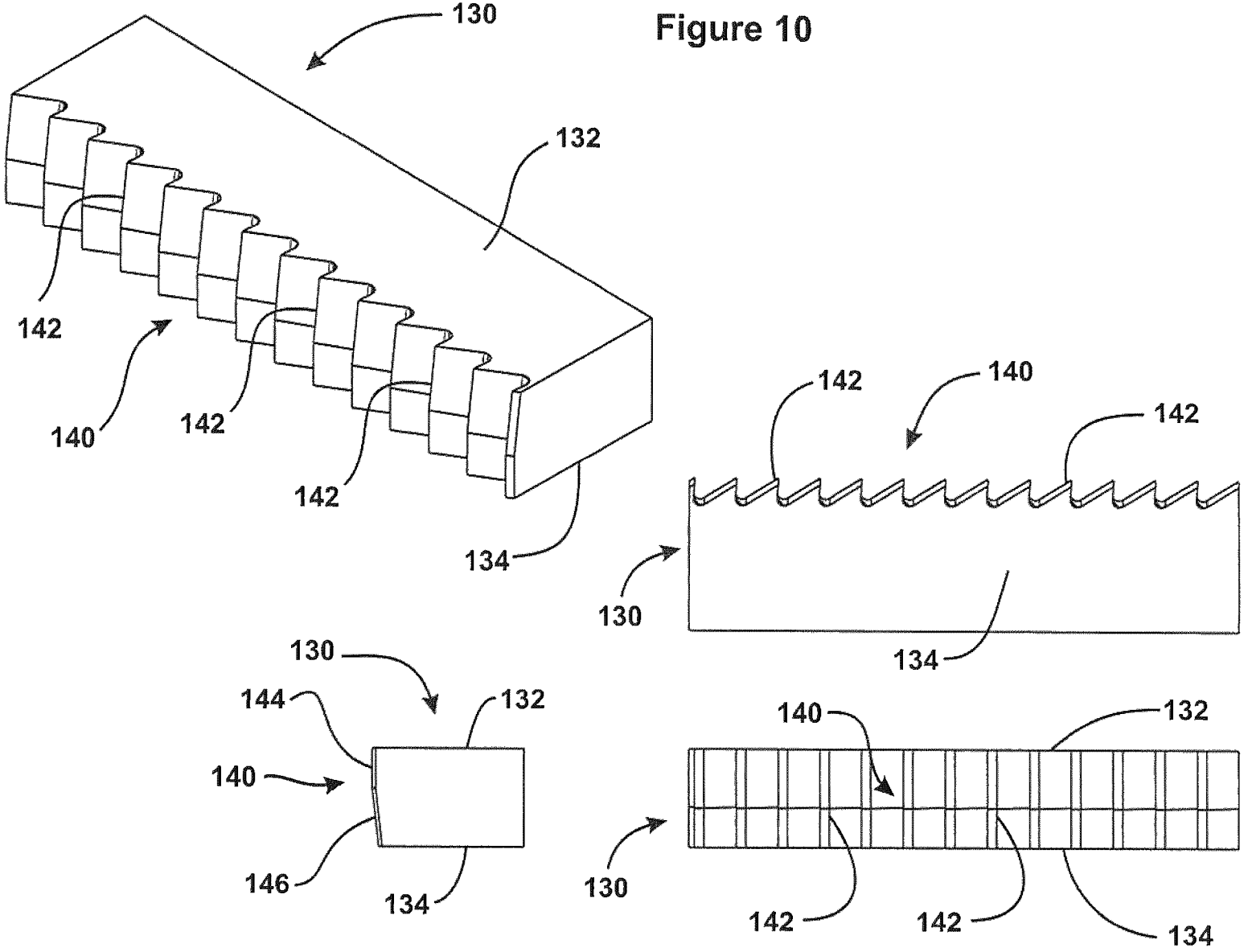
FIG. 10 is a perspective view of another embodiment of a longitudinally extending cutter for sharpening the skate blade of FIG. 1 in accordance with one embodiment of the present invention.

With reference to FIG. 10, another embodiment of a longitudinally extending cutter 130 is illustrated which includes a first cutter wall 132 and a second cutter wall 134. In this embodiment, longitudinally extending cutter 130 has a transverse cutter surface 140 comprised of a first straight surface 144 and a second straight surface 146 and which includes a number of spaced apart parallel teeth 142. In this embodiment, the transverse cutter profile is asymmetrical and beveled.

While the present invention has been described with reference to particular embodiments it will be apparent to anyone skilled in the art that there are many permutations and combinations of combining the primary response variables to achieve particular benefits. All such permutations and combinations are considered to be within the sphere and scope of this invention as defined in the claims appended hereto.

What is claimed is:

1. A manual blade sharpening tool comprising:

a longitudinally extending at least partial channel defined by a longitudinally extending first channel wall and a longitudinally extending second channel wall spaced apart from the longitudinally extending first channel wall, at least a portion of the longitudinally extending second channel wall extending at an outward angle relative to the longitudinally extending first channel wall and being non-parallel with respect to the longitudinally extending first channel wall;

a cutter pocket and a distal planar guide surface located in the longitudinally extending first channel wall, the cutter pocket recessed inwardly from the longitudinally first extending channel wall relative to the distal planar guide surface; and a longitudinally extending cutter having a longitudinally extending first cutter wall, a longitudinally extending second cutter wall and a transverse cutter surface, the longitudinally extending cutter received in the cutter pocket such that the longitudinally extending first cutter wall abuts the cutter pocket, and such that a gap exists between the longitudinally extending second cutter wall and the longitudinally extending second channel wall of the longitudinally extending at least partial channel, wherein the longitudinally extending cutter is secured to the cutter pocket in a removeable manner, the transverse cutter surface including a plurality of spaced apart parallel teeth.

2. The manual blade sharpening tool of claim 1 further comprising a guide plate, the guide plate having a first surface abutting the longitudinally extending first channel wall, an opposing second surface, the opposing second surface including the distal planar guide surface and the cutter pocket.

3. The manual blade sharpening tool of claim 1 wherein the transverse cutter surface has a transverse cutter profile that is arcuate.

4. The manual blade sharpening tool of claim 1 wherein the transverse cutter surface has a transverse cutter profile that is substantially straight.

5. The manual blade sharpening tool of claim 1 wherein the transverse cutter surface has a transverse cutter profile that is asymmetrical.

6. The manual blade sharpening tool of claim 1 wherein the teeth are oriented at an angle relative to a longitudinal axis passing through the longitudinally extending cutter.

7. The manual blade sharpening tool of claim 1 further comprising a longitudinally extending bottom channel wall, the longitudinally extending bottom channel wall adjoining a bottom end of the longitudinally extending first channel wall with a bottom end of the longitudinally extending second channel wall.

8. The manual blade sharpening tool of claim 1, further comprising a body, the body at least partially housing the longitudinally extending at least partial channel.

9. The manual blade sharpening tool of claim 1, wherein the lateral depth of the longitudinally extending cutter is adjustable within the cutter pocket.

10. The manual blade sharpening tool of claim 1 wherein the transverse cutter surface of the longitudinally extending cutter has a width that is sized in order to engage a single edge of a skate blade.

11. The manual blade sharpening tool of claim 1, wherein:

the longitudinally extending second cutter wall of the longitudinally extending cutter is located proximal to a center of the at least partial channel such that a plane defined by the longitudinally extending second cutter wall bisects a lower blade surface of a skate blade when the skate blade is received in the at least partial channel and a first blade surface of the skate blade abuts the distal planar guide surface, and such that the transverse cutter surface does not contact an entirety of the lower blade surface during sharpening of the skate blade.

12. The manual blade sharpening tool of claim 1, wherein:

a lateral position of the longitudinally extending cutter within the at least partial channel is adjustable.

* * * * *